US006926542B2

(12) United States Patent
Li

(10) Patent No.: US 6,926,542 B2
(45) Date of Patent: Aug. 9, 2005

(54) ELECTRICAL CONNECTOR HAVING IMPROVED TERMINALS

(75) Inventor: Chunsheng Li, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/903,648

(22) Filed: Jul. 30, 2004

(65) Prior Publication Data

US 2005/0026474 A1 Feb. 3, 2005

(30) Foreign Application Priority Data

Jul. 30, 2003 (TW) ..... 92213894 U

(51) Int. Cl.[7] ..... H01R 12/00
(52) U.S. Cl. ..... 439/79
(58) Field of Search ..... 439/79, 83

(56) References Cited

U.S. PATENT DOCUMENTS 4,679,883 A 7/1987 Assini et al.
5,277,625 A 1/1994 Iannella et al.
5,906,518 A 5/1999 Sun
6,120,329 A 9/2000 Steinman
6,126,481 A * 10/2000 Wu et al. ..... 439/541.5
6,165,028 A * 12/2000 Hirai et al. ..... 439/857
6,371,811 B1 * 4/2002 Chen et al. ..... 439/607
6,431,882 B1 * 8/2002 Noda et al. ..... 439/79
6,461,173 B1 * 10/2002 Mizuno et al. ..... 439/79
6,505,402 B2 1/2003 Moriwake et al.
6,506,063 B1 * 1/2003 Moriwake et al. ..... 439/79
6,811,433 B2 * 11/2004 Jou ..... 439/541.5

* cited by examiner

*Primary Examiner*—Tho D. Ta
(74) *Attorney, Agent, or Firm*—Wei Te Chung

(57) ABSTRACT

A board-mounted electrical connector (1) includes an insulative housing (10), a number of first terminals (22) and a number of second terminals (26) received in the housing, and a spacer (30) assembled on the housing. The insulative housing includes a base portion (12) defining a number of recesses (124) thereon. Each first terminal includes a contacting portion (222) and a soldering portion (225) extending perpendicularly to a printed circuit board (50). Each second terminal includes a contacting portion (262), a soldering portion (265) extending parallel to the PCB and a connecting portion (264) connecting the contacting portion and the soldering portion. The spacer defines a number of holes (33) for receiving and organizing the soldering portions of the first terminals and forms a number of protrusions (34) cooperating with the recesses of the base portion for organizing corresponding connecting portions of the second terminals to thereby precisely position the soldering portions of the second terminals.

6 Claims, 9 Drawing Sheets

ELECTRICAL CONNECTOR HAVING IMPROVED TERMINALS

CROSS-REFERENCE TO RELATED APPLICATIONS

Relevant subject matter is disclosed in a copending U.S. Patent Ser. No. application 10/879,675 titled "ELECTRICAL CONNECTOR HAVING A SPACER", which is assigned to the same assignee with this application.

BACKGROUND OF THE INVENTION

1. Field of the Invention

The present invention generally relates to an electrical connector, and particularly to an electrical connector mounted on a printed circuit board.

2. Description of Related Arts

It is well known that an electrical connector mounted on a printed circuit board (PCB) by either Through Hole Technology (THT) or Surface Mount Technology (SMT). U.S. Pat. No. 4,679,883 discloses a board-mounted electrical connector comprising an insulative housing and a plurality of terminals received in the insulative housing which are electrically connected to the PCB through THT. Conventionally, the soldering portions of the THT terminals should be accurately aligned with corresponding through-holes on the PCB to facilitate the soldering procedure thereby achieving a reliable electrical connection therebetween. While, the soldering portions of the SMT terminals should have good coplanarity thereof to be precisely soldered with corresponding pads on the PCB. However, a problem occurs, when THE terminals and SMT terminals are simultaneously required in one electrical connector in some applications, that it is difficult to achieve an accurately positioning between the soldering portions of THE and SMT terminals with respect to corresponding through-holes and pads of the PCB at the same time.

Hence, it is desirable to have an improved connector to overcome the above-mentioned disadvantages of the related art.

BRIEF SUMMARY OF THE INVENTION

Accordingly, it is an object of the present invention to provide an electrical connector, the terminals of which can be accurately soldered with a printed circuit board.

It is another object of the present invention to provide an electrical connector having two different kinds of terminals, which are assembled in an insulative housing without interfering with each other.

In order to achieve the above-mentioned objects, an electrical connector in accordance with the present invention, which is adapted for mounting on a printed circuit board (PCB), comprises an insulative housing and a plurality of first and second terminals. The insulative housing comprises a base portion and a mating portion extending forwardly from the base portion. The mating portion defines a plurality of passageways extending therethrough and respectively arranged in upper and lower rows. Each first terminal comprises a contacting portion received in a corresponding passageway of the upper row, a soldering portion extending perpendicularly to the PCB, and a connecting portion connecting the soldering portion and the contacting portion. Each second terminal comprises a contacting portion received in a corresponding passageway of the lower row, a soldering portion extending parallel to the PCB and connecting portion connecting the contacting portion and the soldering portion. Each connecting portion of the second and first terminals comprises a first portion and a second portion. The contacting portion and the first portion are arranged in a vertical plane, and the second portion and the soldering portion are arranged in another same vertical plane.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
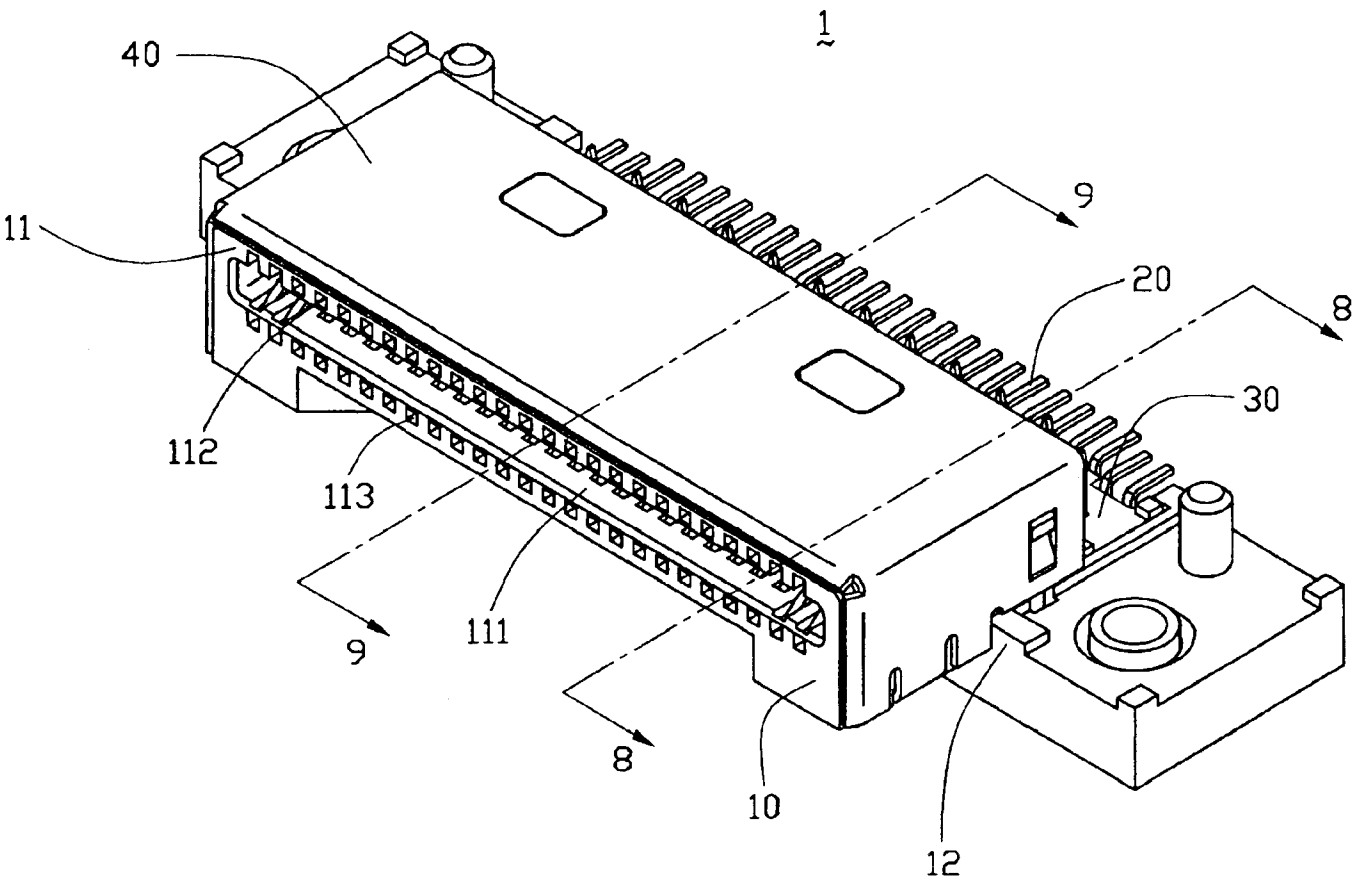
FIG. 1 is a perspective view of an electrical connector in accordance with the present invention.
Figure 2:
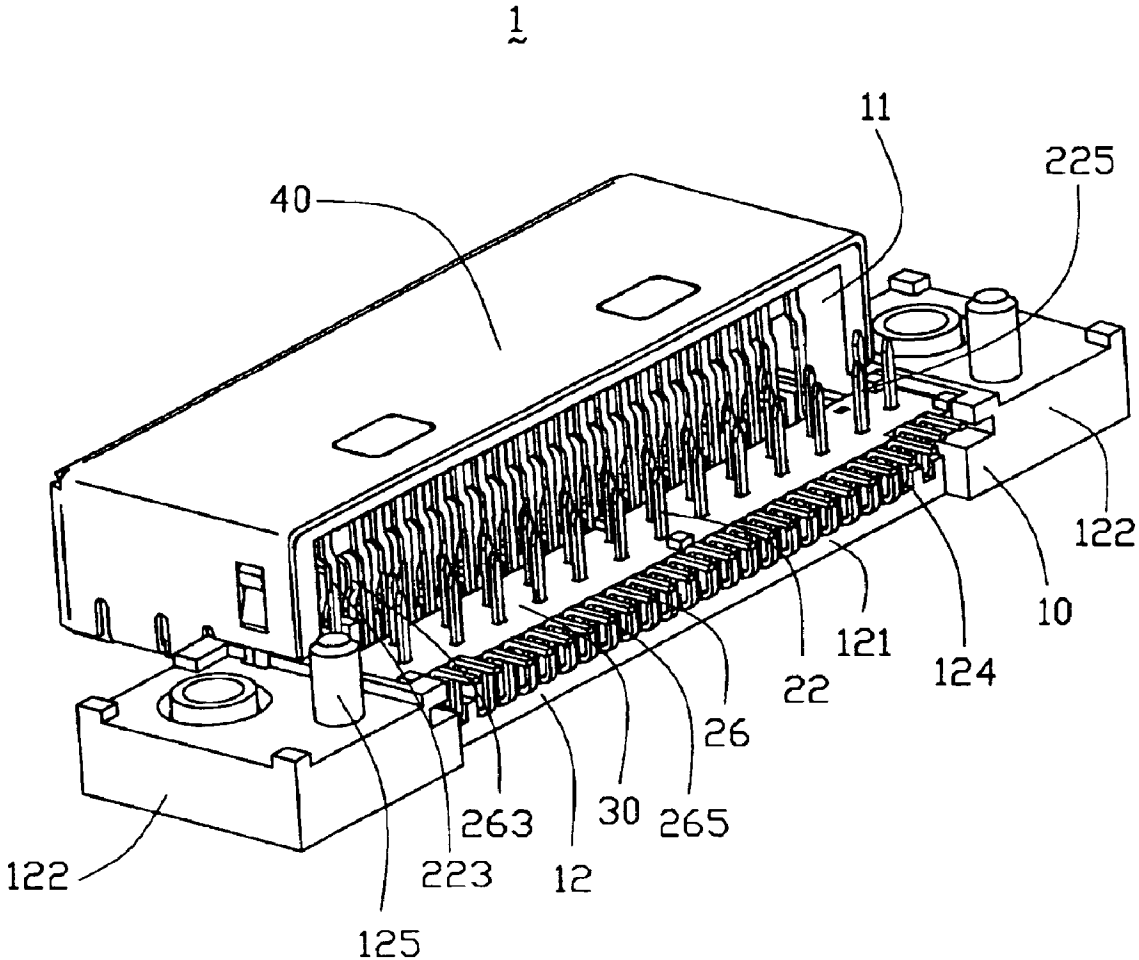
FIG. 2 is another perspective view of the electrical connector shown.

Reference will now be made to the drawing figures to describe the present invention in detail.

With reference to FIGS. 1–4, an electrical connector in accordance with the present invention, which is adapted for mounting on a printed circuit board (PCB) 50, comprises an insulative housing 10, a plurality of terminals 20 received in the insulative housing 10, a spacer 30 mounted on the insulative housing 10 and a shell 40.

The insulative housing 10 comprises a base portion 12 and a mating portion 11 extending forwardly from the base portion 12. The mating portion 11 comprises a mating port 111 and a plurality of first and second passageways 112, 113 extending through. The mating port 111 defines a receiving space 114 for mating with a complementary connector (not shown). The first passageways 112 and the second passageways 113 are arranged in upper and lower rows, respectively, for receiving the terminals 20. The base portion 12 comprises a pair of ladder portions 122 at the opposite ends thereof and an intermediate portion 121 connecting the ladder portions 122. The ladder portion 122 has a thickness larger than that of the intermediate portion 121, and forms a post 125 projecting upwardly therefrom for mounting to the PCB 50. The ladder portion 122 further comprises a retaining cavity 128 (FIG. 3) adjacent to the intermediate portion 121. The intermediate portion 121 defines a plurality of ribs 123 (FIG. 4) thereon, and every two ribs 123 define a recess 124 therebetween.

Figure 3:
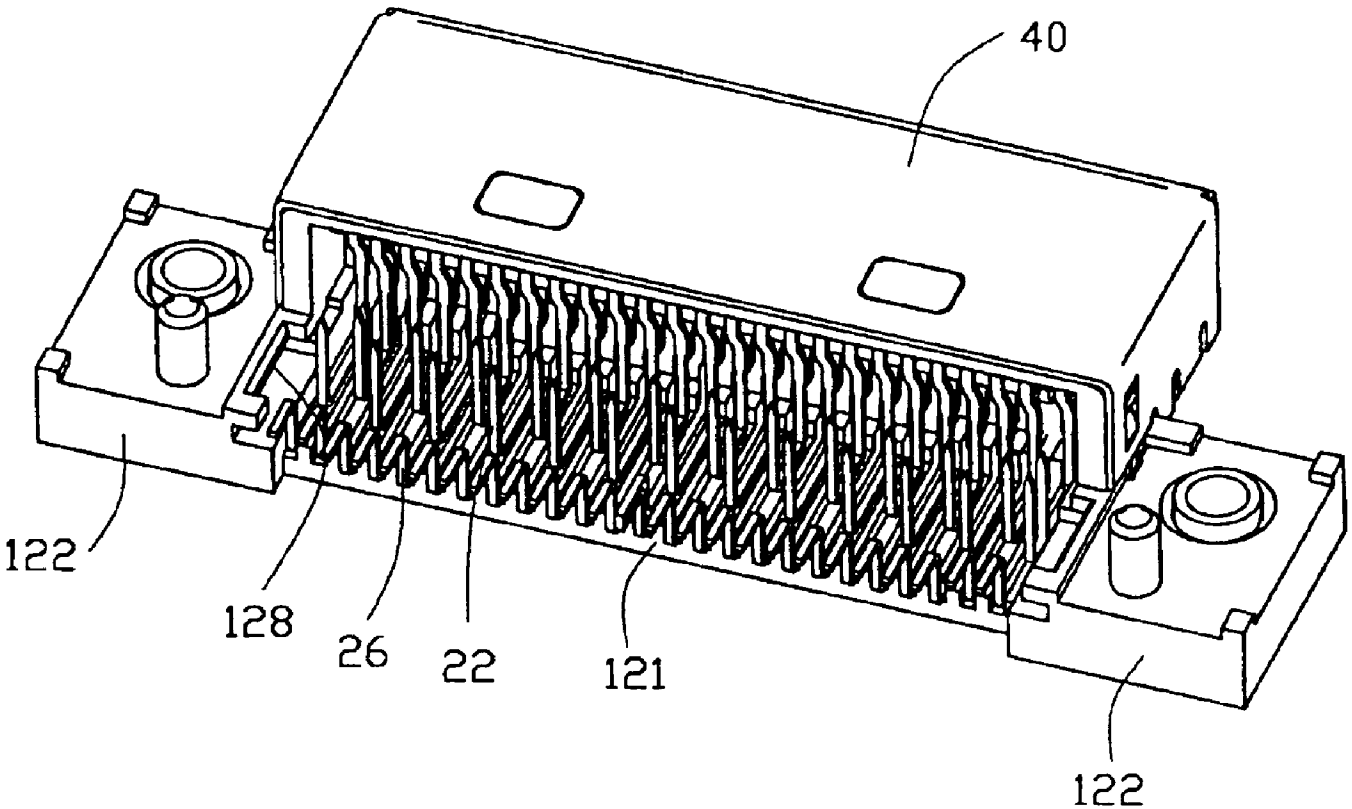
FIG. 3 is a perspective view of the electrical connector with a spacer being removed therefrom.
Figure 4:
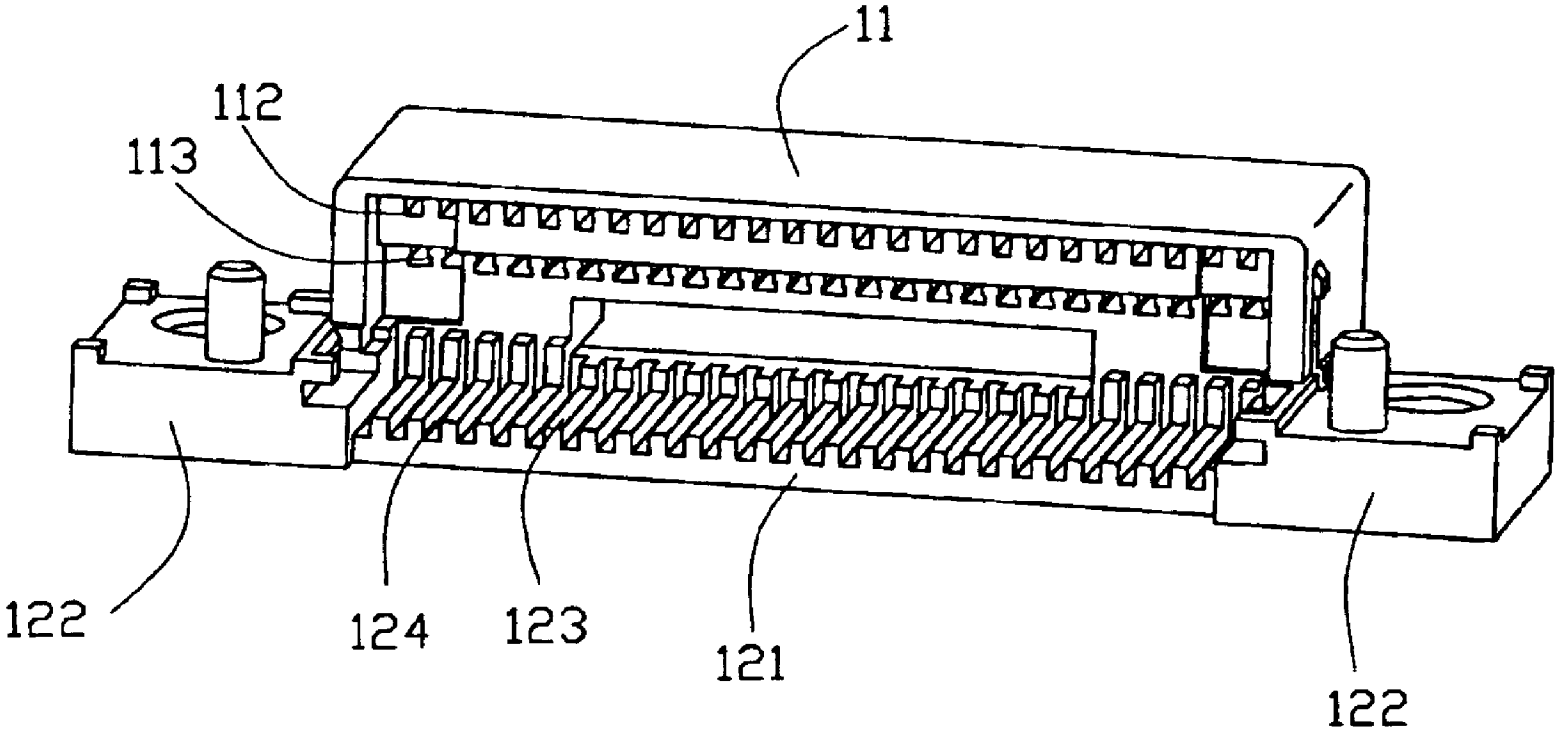
FIG. 4 is a perspective view of the electrical connector with terminals being removed therefrom.
Figure 5:
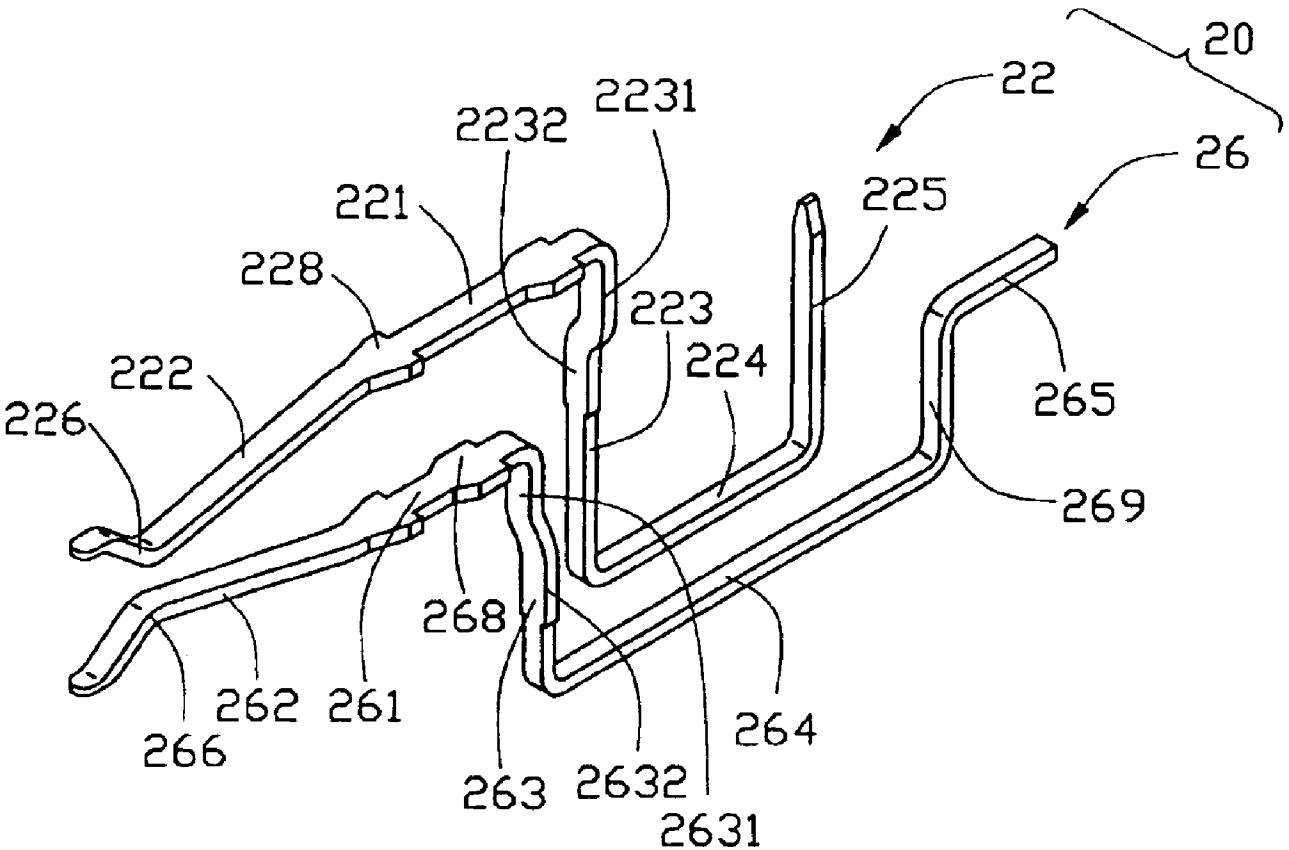
FIG. 5 is a perspective view of a first and a second terminals of the electrical connector.
Figure 8:
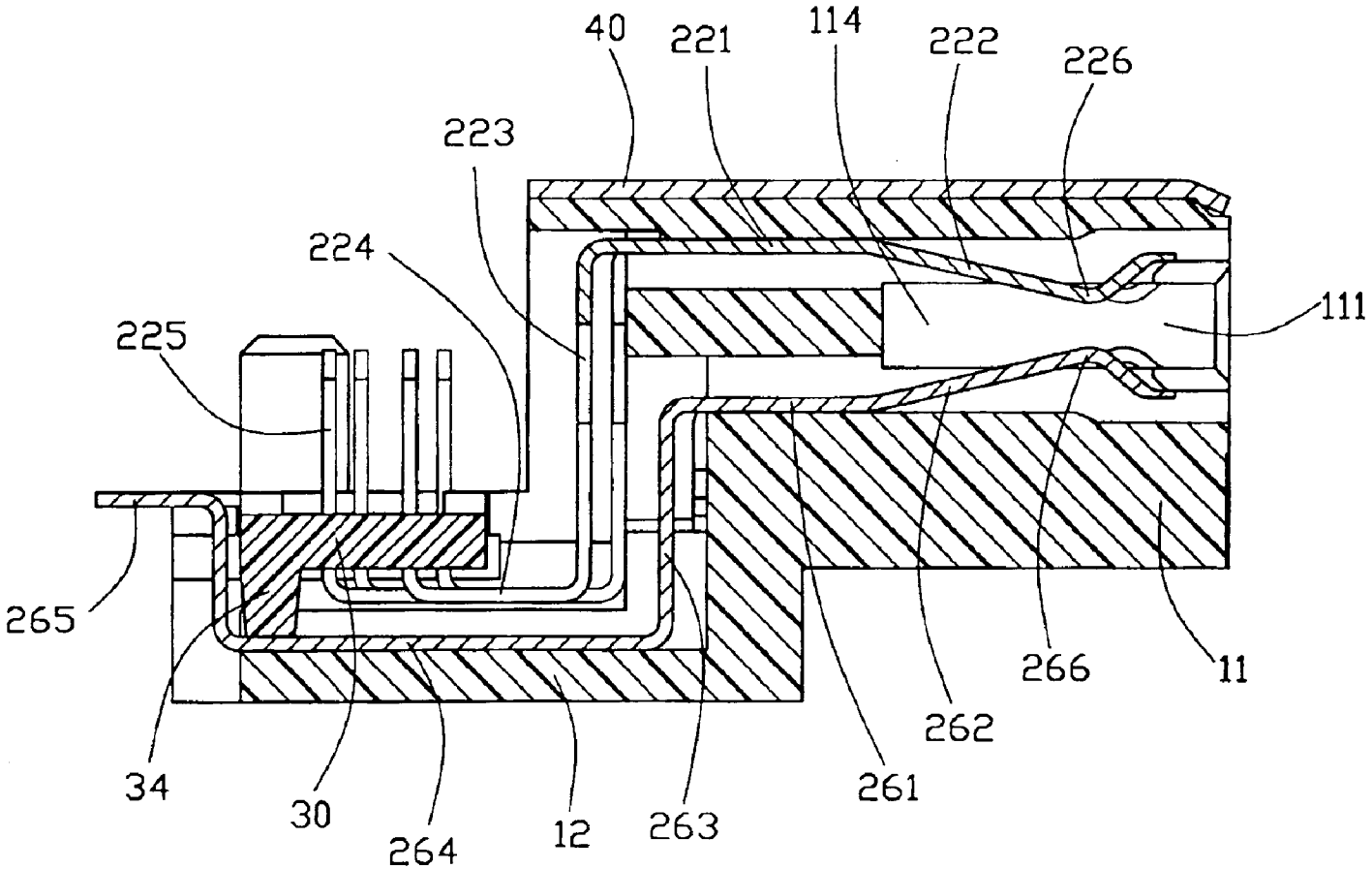
FIG. 8 is a cross-sectional view of the electrical connector shown in FIG. 1 taken along line 8—8.
Figure 9:
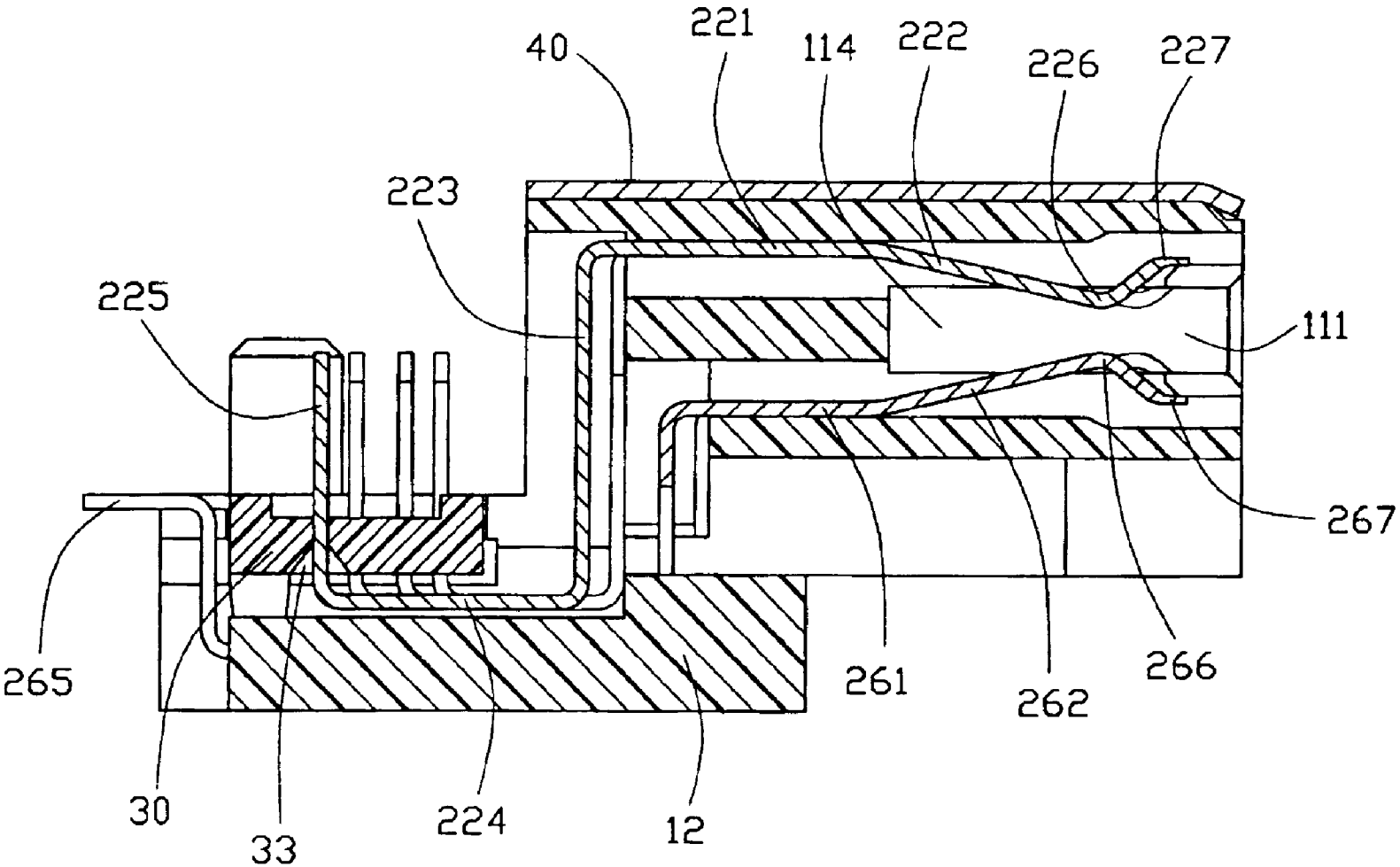
FIG. 9 is a cross-sectional view of the electrical connector shown in FIG. 1 taken along line 9—9.

With reference to FIG. 3 and FIG. 5 in conjunction with FIG. 8–9, the terminals 20 comprise a plurality of first terminals 22 and a plurality of second terminals 26. Each first terminal 22 comprises a retaining portion 221 retained in the corresponding first passageway 112, a contacting portion 222 extending downwardly and forwardly from the retaining portion 221, a vertically extending portion 223 extending from the retaining portion 221, a connecting portion 224 extending horizontally from the vertically extending portion 223, and a soldering portion 225 extending upwardly from the connecting portion 224 opposite to the vertically extending portion 223. The contacting portion 222 forms a projecting portion 226 at a distal end thereof. The connecting portions 224 of every two adjacent first terminals 22 have different lengthes. The vertically extending portion 223 comprises a first portion 2231 and a second portion 2232 extending slanting wise and downwardly from the first portion 2231. Each second terminal 26 comprises a retaining portion 261 retained in corresponding second passageway 113, a contacting portion 262 extending upwardly and forwardly from the retaining portion 261, a vertically extending portion 263 extending from the retaining portion 261, a connecting portion 264 extending horizontally from the vertically extending portion 263, an intermediate portion 269 extending upwardly from the connecting portion 264, and a soldering portion 265 extending rearwardly from the intermediate portion 269. The contacting portion 262 forms a projecting portion 266 at a distal end thereof. The vertically extending portion 263 of the second terminal 26 also comprises a first portion 2631 and a second portion 2632 extending slanting wise and downwardly from the first portion 2631. The retaining portions 221, 261 of the first and second terminals 22, 26 are formed with a plurality of barbs 228, 268 thereon. The soldering portions 225 of the first terminals 22 extend perpendicular to the PCB 50, and the soldering portions 265 of the second terminals 26 extend parallel to the PCB 50.

It can be readily seen from FIG. 5 that the contacting portion 222/262, the retaining portion 221/261 and the first portion 2231/2261 of the first/second terminal 22/26 are arranged in a same plane, while the second portion 2232/2632, the connecting portion 224/264 and the soldering portion 225/265 are arranged in another plane. The soldering portion 225, 265 of the first terminal 22 and the second terminal 26 are oppositely arranged with respect to the contacting portion 222, 262 which are extending in the same plane.

Figure 6:
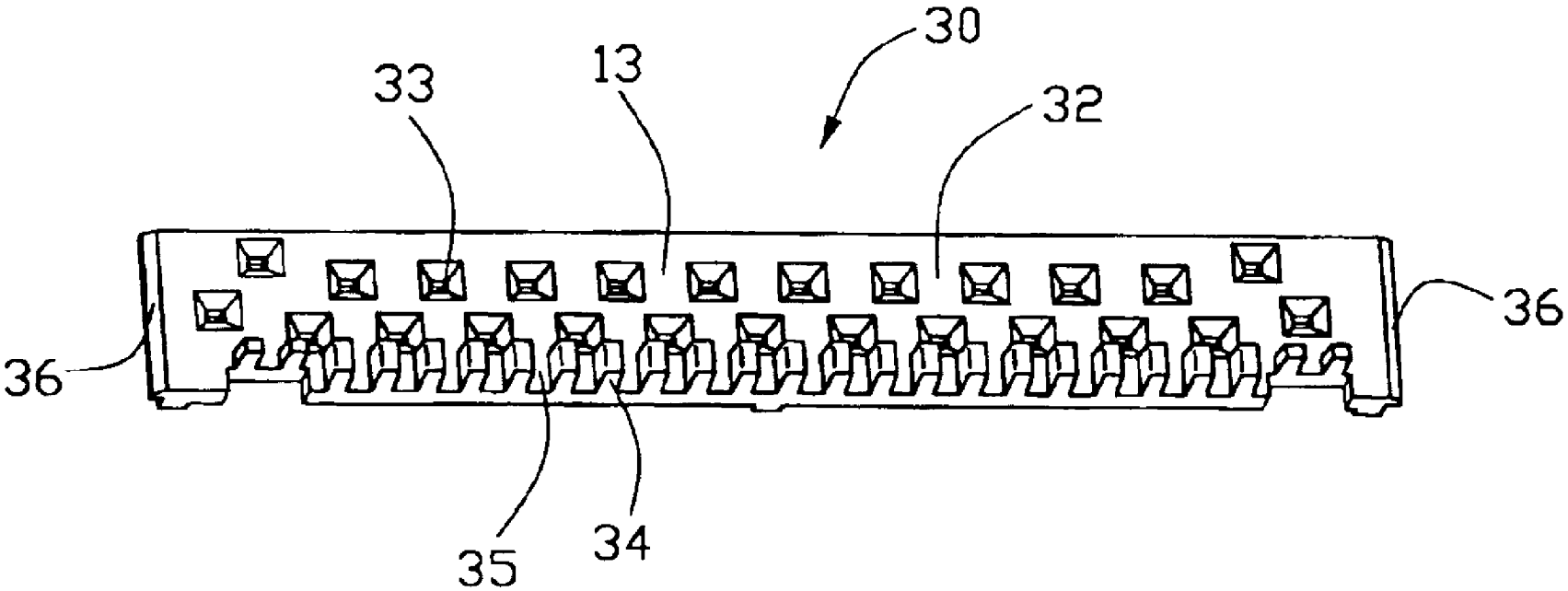
FIG. 6 is a perspective view of the spacer.

With reference to FIG. 6, the spacer 30 comprises a base 32 with a pair of projections 36 extending from opposite ends thereof, and defines a plurality holes 33 extending through the spacer 30. The spacer 30 is formed with a plurality of protrusions 34. Every two adjacent protrusions 34 define a slot 35 therebetween.

Figure 7:
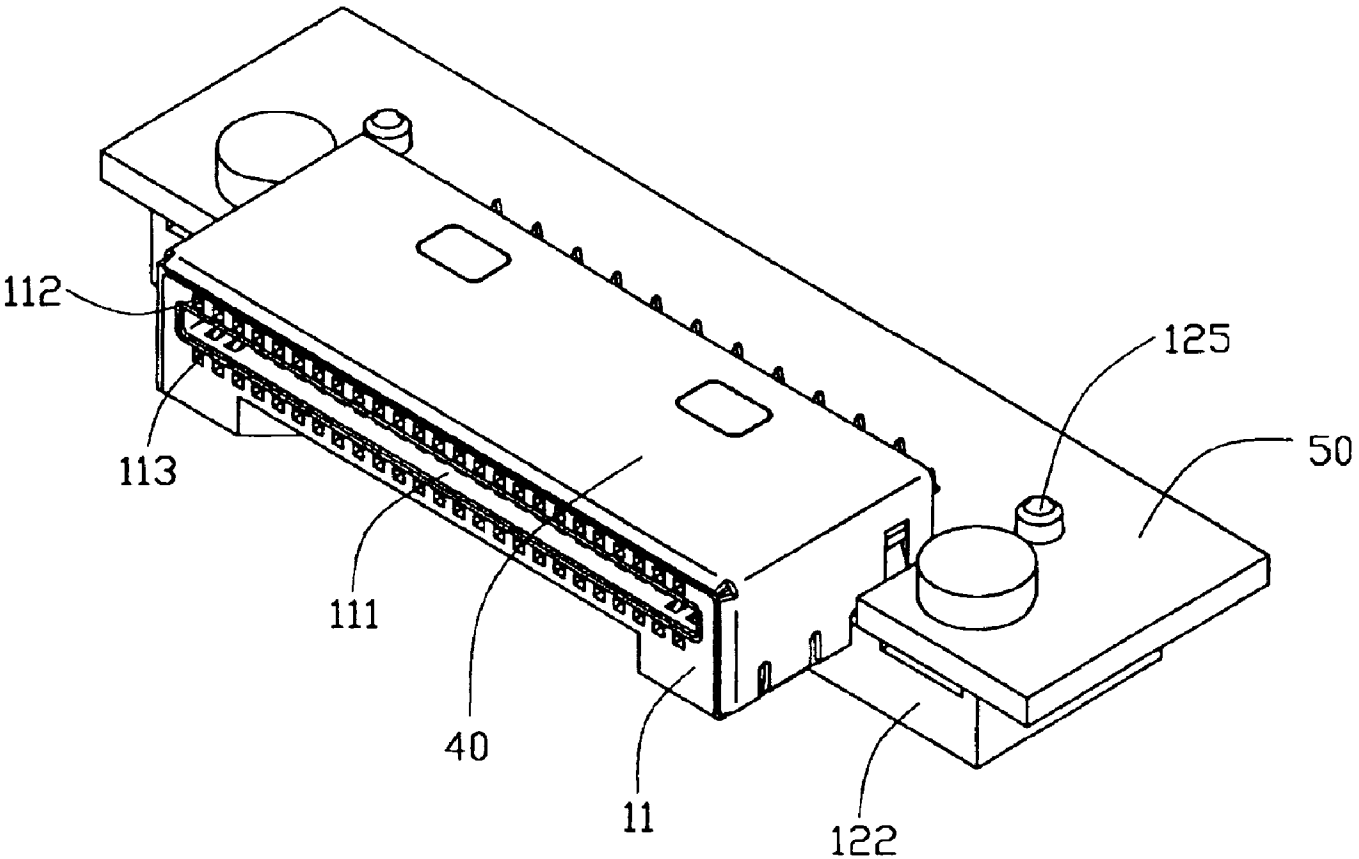
FIG. 7 is a perspective view of the electrical connector assembled on a printed circuit board.

With reference to FIG. 7, the shell 40 is stamped from a piece of metal sheet and encloses a top face and opposite side faces of the mating portion 11.

After the assembly of the electrical connector 1, the retaining portion 261 and the contacting portion 262 of the second terminal 26 are held in corresponding second passageway 113 by the barbs 268 engaging with an inner face of the corresponding second passageway 113. The projecting portion 266 of the second terminal 26 extends into the receiving space 114. The connecting portion 264 of the second terminal 26 is received in the corresponding recess 124 of the base portion 12. The first terminals 22 are inserted into the first passageways 112 in substantially the same direction to the second terminals 26. The connecting portions 224 of the first terminals 22 are positioned on the corresponding ribs 123 of the base portion 12. The two projections 36 of the spacer 30 are respectively received in the retaining cavities 128 of the ladder portions 122. The soldering portions 225 of the first terminals 22 extend through the corresponding holes 33 of the spacer 30 for finally soldering to the PCB 50. The protrusions 34 of the spacer 30 are pressed into the recesses 124 of the intermediate portion 121 of the base portion 12 and abut against the connecting portions 264 of the second terminals 26. The ribs 123 of the intermediate portion 121 are received in the corresponding slots 35 of the spacer 30 so that the spacer is secured on the housing 10 and precisely organizes the soldering portions 225, 265 of the terminals 20. The electrical connector 1 is assembled to the PCB 50 with the posts 125 thereof inserting into corresponding positioning holes (not labeled) of the PCB 50. The soldering portions 225 of the first terminals 22 are inserted into and soldered with corresponding soldering holes (not labeled) of the PCB 50 and the soldering portions 265 of the second terminals 26 are soldered to corresponding pads (not shown) on a bottom face of the PCB 50 by a way of SMT. Further, the electrical connector 1 is retained on the PCB 50 by screws (not labeled).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector adapted for mounting on a printed circuit board (PCB), comprising:

an insulative housing comprising a base portion and a mating portion extending forwardly from the base portion, the mating portion defining a plurality of passageways extending therethrough;

a plurality of terminals arranged in a lower and an upper rows, each terminal comprising a contacting portion received in a corresponding passageway, and a soldering portion extending outwardly from the insulative housing, each pair of contacting portions in the upper and lower rows being positioned in a common plane, and associated soldering portion being not in the plane;

wherein each terminal comprises a retaining portion extending rearwardly from the contacting portion, a vertically extending portion extending from the retaining portion, and a connecting portion extending between the vertically extending portion and the soldering portion;

wherein the vertically extending portion of each terminal comprises a first portion and a second portion extending slantingwise and downwardly from the first portion;

wherein the contacting portion, the retaining portion and the first portion are positioned in a common plane, and the soldering portion, the connecting portion and the second portion are positioned in another common plane; and wherein the terminals comprise a plurality of first terminals positioned in the upper row, and a plurality of second terminals positioned in the lower row, the soldering portion of each first terminal being perpendicular to a PCB, and the soldering portion of each second terminal being parallel to the PCB.

2. The electrical connector as described in claim 1, wherein each second terminal comprises an intermediate portion extending perpendicularly from the connecting portion for connecting the connecting portion and the soldering portion.

3. The electrical connector as described in claim 1, wherein the connecting portions of every two adjacent first terminals have different lengths, and the soldering portions of the two first terminals are staggered with each other.

4. The electrical connector as described in claim 1, wherein the base portion of the insulative housing comprises a pair of opposite ladder portions and an intermediate portion extending between the ladder portions.

5. The electrical connector as described in claim 1, further comprising a shell enclosing the mating portion of the housing and a spacer assembled on the base portion.

6. The electrical connector as described in claim 1, wherein the spacer defines a plurality of recesses and protrusions alternately defined thereon.

* * * * *